United States Patent [19]

Tanaka

[11] 3,977,314

[45] Aug. 31, 1976

[54] TYING DEVICE

[75] Inventor: Masashi Tanaka, Shizuoka, Japan

[73] Assignee: Fuji Jidoki Kabushiki Kaisha, Japan

[22] Filed: May 23, 1974

[21] Appl. No.: 472,526

[30] Foreign Application Priority Data

May 24, 1973 Japan ..... 48-57192

[52] U.S. Cl. ..... 100/4; 100/16; 100/30

[51] Int. Cl.[2] ..... B65B 13/04

[58] Field of Search ..... 100/4, 26, 30, 3, 16

[56] References Cited

UNITED STATES PATENTS

| | | | |
|---|---|---|---|
| 2,764,082 | 9/1956 | Saquet | 100/30 |
| 3,066,599 | 12/1962 | Koehler | 100/30 X |
| 3,215,064 | 11/1965 | Koehler | 100/30 X |
| 3,587,449 | 6/1971 | Meckler | 100/30 |

*Primary Examiner*—Billy J. Wilhite
*Attorney, Agent, or Firm*—Connolly and Hutz

[57] ABSTRACT

A tying device comprising: a stand for mounting thereon an object to be tied with a tape; a slot for feeding the tying tape; a detector, disposed beyond the forward end of the slot, for detecting the end of the tying tape; a bendable arm having a grip mechanism and pivotally provided on the stand substantially in parallel to the slot, the bendable arm being adapted to be swung upward, so that when the end of the tying tape reaches the detector, the detector produces a signal to actuate the grip mechanism to grip the end of the tying tape and actuate the bendable arm to swing upward so as to bring the end of the tying tape over the object to be tied to the underside of the object and overlap the end on a portion of the tying tape which has been fed thereto.

4 Claims, 15 Drawing Figures

TYING DEVICE

The present invention relates to a tying device for fastening a tying tape around an object to be tied.

When an object to be tied is short or when an end portion of an object is tied even if the object to be tied is long, such object can be automatically tied relatively easily by winding a tying tape around the object by holding the tape at the end of a swingable arm whose rotary axis is positioned adjacent to the end portion of the object to be tied. However, automatic tying of a long object at its midpoint or vicinity with a tape necessitates installation, on the upper surface of the stand for mounting the object, of a special guide which guides the typing tape upward from below the object and then returns it to overlap on a portion of the tape which has been fed thereto. This inevitably results in the drawback complexity and bulkiness of structure, making it impossible to produce a neat appearance of the device. Meanwhile a structure with a built-in tape grip mechanism results in another drawback of a very complex mechanism for gripping the tape and sending it to the feeding side. An object of the present invention is to provide a tying device for fastening a tying tape around an object to be tied, which is free from the above-mentioned drawbacks.

The invention will be now described by way of an example referring to the accompanying drawings illustrating an embodiment thereof, in which, FIG. 1 is an overall perspective view of the tying device according to the present invention;

Figure 1:
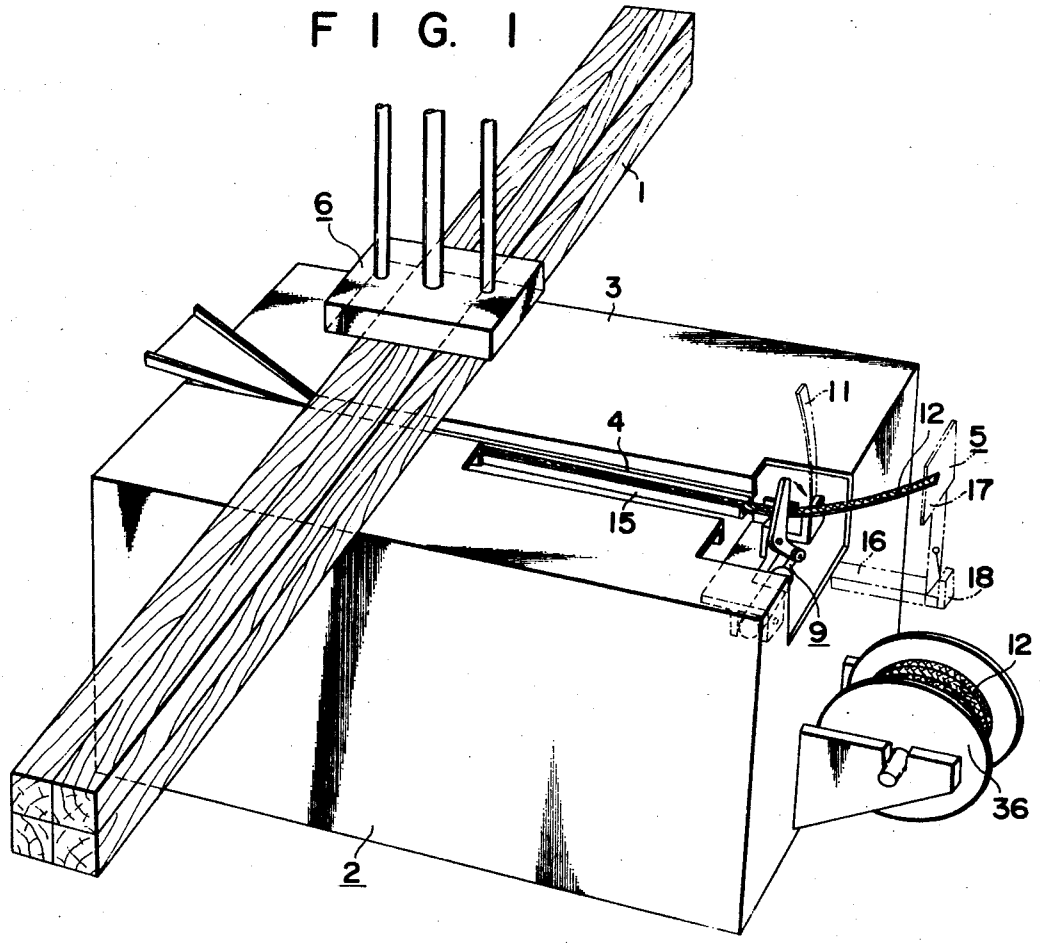
Figure 13A:
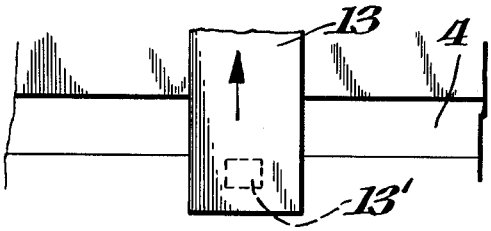
FIGS. 13*a*—13*c* illustrate the limit switch on the upper guide plate and its three positions relative to the tape slot.
Figure 13B:
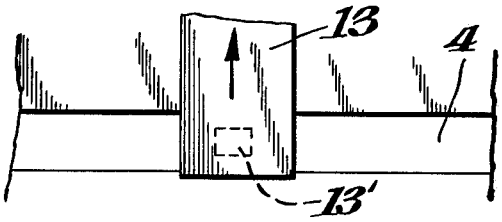
Figure 13C:
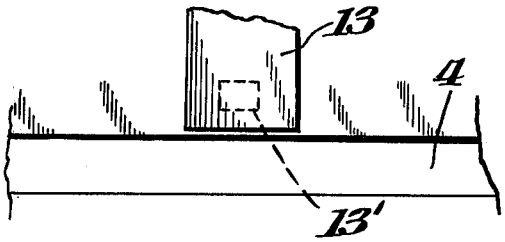

In FIG. 1, a stand 2 for mounting an object 1 to be tied is formed on its table 3 with a slot 4 for feeding a tying tape 12. The object to be tied, mounted on the stand 2 is pressed by suitable presser means 6. The slot 4 is provided internally with upper and lower guide plates 13 and 14 respectively for guiding the tape 12 (see FIG. 2) and a tape guiding gutter 15. In front of the forward end of the slot 4 is provided a tape-end detector 5. The detector 5 includes a limit switch 18 provided ahead of the deflecting end of a stop plate 17 erected on a support 16 (see FIG. 1) which is projecting beyond the forward end of the stand 2. The upper, guide plate 13 is provided with a limit switch 13' on the underside thereof and the plate moves in three steps in the vertical direction to the plane of the sheet of FIG. 2, namely in a transverse direction to the slot 4. When the tape is initially fed into the slot 4 the upper guide plate 13 is positioned such that the limit switch is out of contact with the tape being fed. Afterwards, the upper guide plate 13 is moved so as to position the limit switch at a location where the tape may engage the limit switch during the course of the tying operation. Hence, the initial position of the plate 13 as shown in FIG. 13*a* is away from the tape slot 4 and thereby away from the path of movement of the tape 12 when it is initially fed into the machine and arrives at the detector 5. The next position of the limit switch 13' as shown in FiG. 13*b* is such that the end of the tape 12 engages it after the tape is wrapped around the object being tied. As explained more fully below, activation of the switch at this stage causes the guide plate 35 to swing and thereby clamp the end of the tape between the plate 13 and the tip of the guide plate 35. Moreover, after the binder 45 secures the tape to the object, the plate 13 shifts to its third position as shown in FIG. 13*c* which ultimately releases the tied object from the machine.

In the slot 4, a first bent arm 7 which is bent substantially at right angles and which is disposed substantially in parallel to the slot 4 is pivoted to the stand 2 by a pin 19. A piston rod 21 of a fluid drive cylinder 20 pivoted to the stand 2 is pivoted to the first bent arm 7 at a part 22 thereof. At the forward end of the first bent arm 7 is pivoted a second bent arm 8 which is similarly bent at right angles. At the forward end of the second bent arm 8 is provided a fold-grip mechanism 9 for the tying tape which will be described in detail hereinafter. A fluid drive cylinder 10 is pivoted to the first bent arm 7 at another part 23 thereof and an end of a piston rod 24 of the cylinder 10 is pivoted to the second bent arm 8 at a part 25 thereof.

Figure 2:
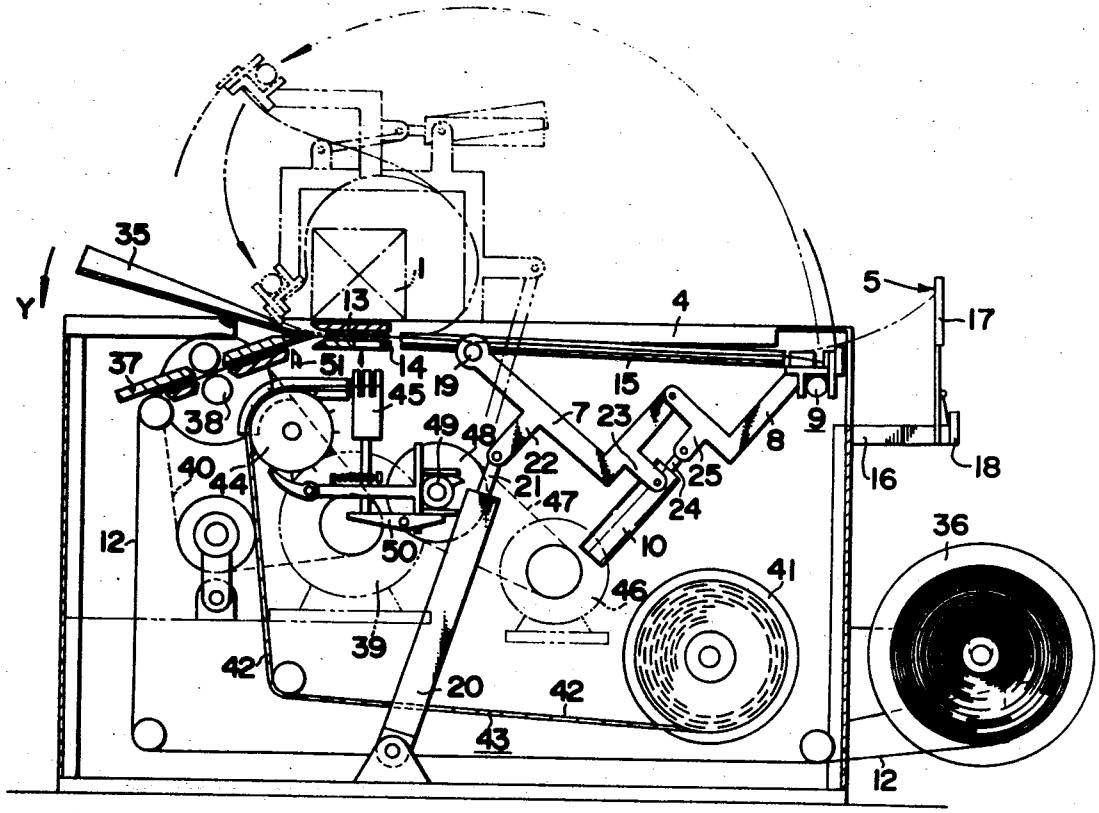
FIG. 2 is a longitudinally sectional elevation of the tying device of FIG. 1.
Figure 3:
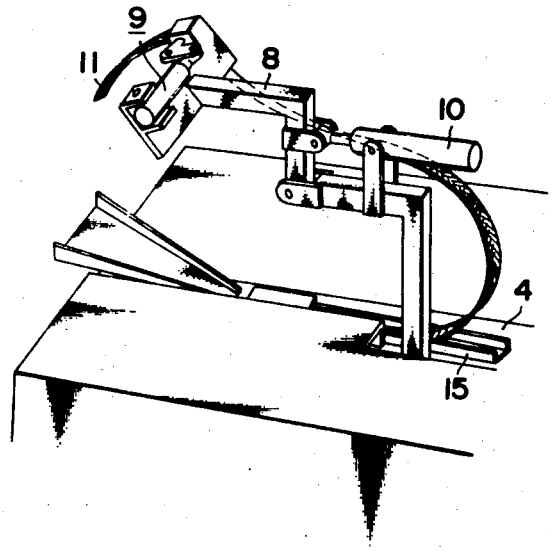
FIGS. 3 and 4 are partially perspective views illustrating the arm action of the tying device.
Figure 4:
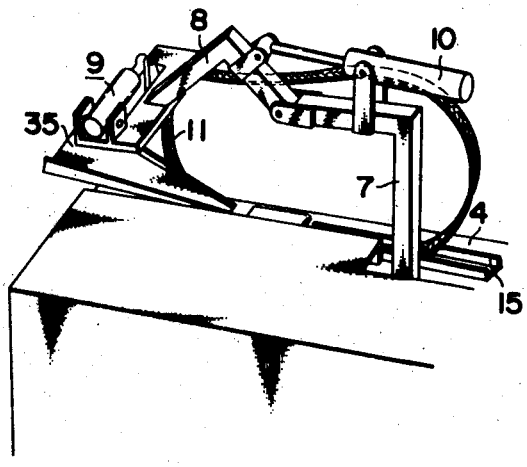
Figure 5:
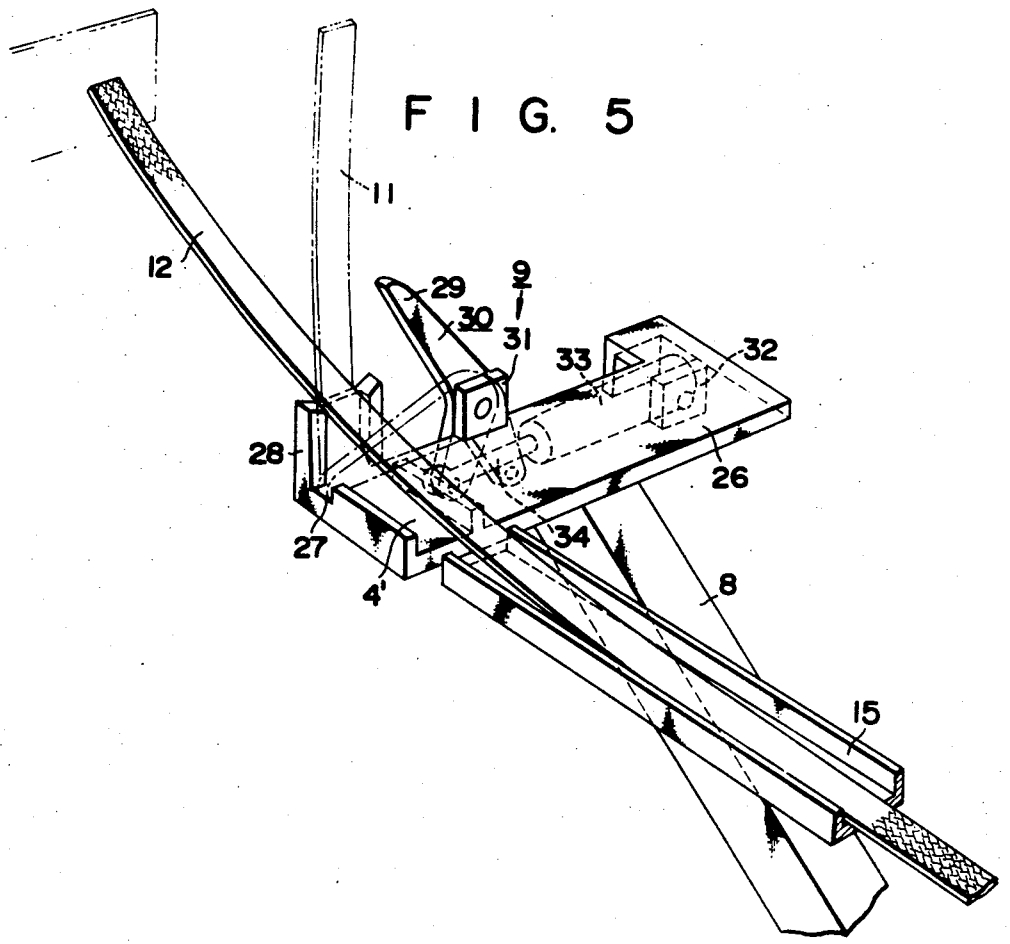
FIG. 5 is an enlarged perspective view of a tape fold-grip mechanism of the tying device.
Figure 6:
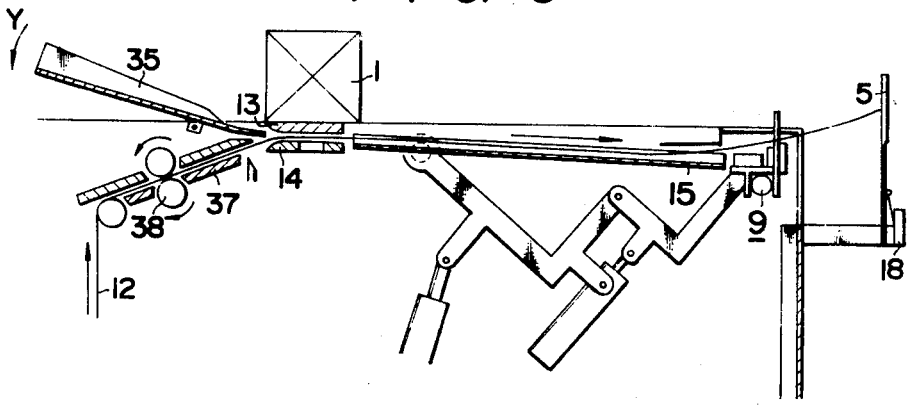
FIGS. 6 to 10 are diagrams showing the functions of the tying device.

As shown in an enlarged perspective view of FIG. 5, in the tape fold-grip mechanism 9, a support table 26 is provided at the end of the second bent arm 8. A groove 4' is formed on the support table 26 in the manner so that the groove 4' comes on the extended line from the tape feed slot 4 and follows the tape guiding gutter 15 when the first and second bent arms 7 and 8 are withdrawn into the tape feed slot 4 as shown in FIG. 2. Beyond the groove 4' is provided a transverse groove 27 intersecting the groove 4' at right angles. A rise wall 28 is provided beyond the transverse groove 27 on the table 26. A tape hold lever 30, one end 29 of which is adapted to fit into the transverse groove 27, is pivoted to the support table 26 at a part 31 thereof. The other end of the lever 30 is pivoted to the end of a piston rod 34 of a fluid drive cylinder 33 which is pivoted to the support table 26 at a part 32 on the underside thereof. Thus when the fluid drive cylinder 33 is actuated, the tape-hold lever 30 swings to a position indicated by a one dot-chain line in FIG. 5 to press the tape 12 into the transverse groove 27 and thereby fold the tape 12 along the rise wall 28 to make a fold 11 as indicated by a two dot-chain line.

As shown in FIG. 2, a guide plate 35 for the tape fold 11 is pivoted to the stand 2 at one part thereof. When the plate 35 swings in the arrowy direction, the tip of the plate 35 presses the upper guide plate 13, thereby firmly squeezing the end portion of the tape. Any suitable means may be provided for swinging the plate, such as a conventional fluid drive cylinder (not shown) similar to cylinders 10 and 33, for example. The tying tape 12 is fed from a tape reel 36 through a tape guide 37, tape feed rolls 38 driven by a motor 39 via a chain 40 and the guide plates 13 and 14 into the tape guiding gutter 15 in turn. When the tape tip through the guide plate 35 touches the limit switch provided on the back side of the upper guide plate 13, the guide plate 35 is swung as described above and at the same time, the rolls 38 are reversed for straining the tape 12. A belt 43 composed of tape end bundle metals 42 is fed from a reel 41 through a feed roll 44 for intermittently feeding the bundle metals. A bundle metal pushup-binder 45 is so arranged as to go up or down via a lever 50 by means of a cam 49 mounted on the shaft of a chain wheel 48 driven by a motor 46 via a chain 47, so that a piece of bundle metal 45 is squeezed from both sides to tie the object together with tape. The intermittent feed roll 44 is also driven by the cam 49. A cutting edge 51 is provided for cutting the tape 12. However the structural relation between this tape cutting edge and the bundle metal pushup-binder 45 is omitted, because not only would the description of this relation complicate the understanding of the present invention but also such structure would have no direct bearing on the present invention.

Figure 7:
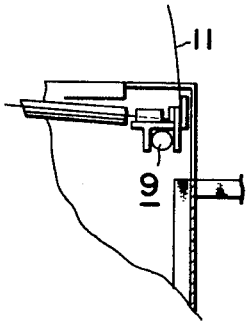

In the thus arranged embodiment of the present invention, the tape feed rolls 38 feed the tying tape 12 via the tape guide 37, the upper and lower guide plates 13 and 14 and the tape guiding gutter 15 in the slot 4 as indicated in FIG. 7. When the tip of the tape 12 hits the detector 5, to actuate the limit switch 18 the fluid drive cylinder 33 of the tape fold-grip mechanism 9 is actuated to cause the tape hole lever 30 to press the tape into the transverse groove 27 with the end portion 29 of the lever and fold the tape end to make the fold 11, as illustrated in FIG. 7.

Figure 8:
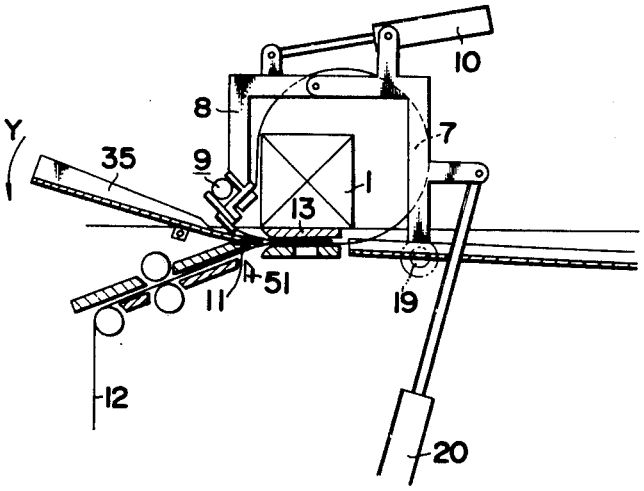

Next, as illustrated in FIG. 8 the actuation of the fluid drive cylinder 20 causes the first bent arm 7 to swing upward around the pin 19 and the actuation of the fluid drive cylinder 10 causes the second bent arm 8 to swing relative to the first bent arm 7, so that the tape end is brought over the object to be tied. The fold 11 of the end of the tape 12 is then guided by the guide plate 35 to go into the gap between the underside of the upper guide plate 13 at the bottom of the object 1 to be tied and the tip of the guide plate 35 and travels overlapping on a portion of the tape 12 which has been fed thereto until it touches the limit switch provided on the backside of the upper guide plate 13.

Figure 9:
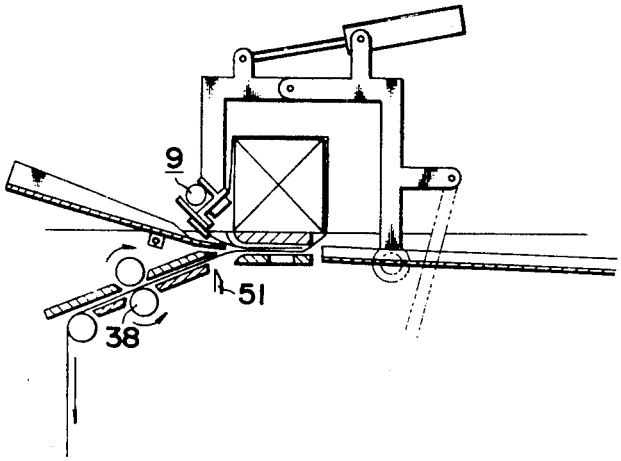

In response to the actuation of the limit switch, the guide plate 35 swings in the arrowy direction Y so that the tape end is clamped between the upper guide plate 13 and the tip of the guide plate 35. Thus, when the tape feed rolls 38 are reversed as illustrated in FIG. 9, with the fold 11 clamped as described above, the tape 12 is caused to tie the object 1. In the meantime the tape hold lever 30 reverts to the original position, so that the tape is strained tightly around the object 1 to be tied.

Figure 10:
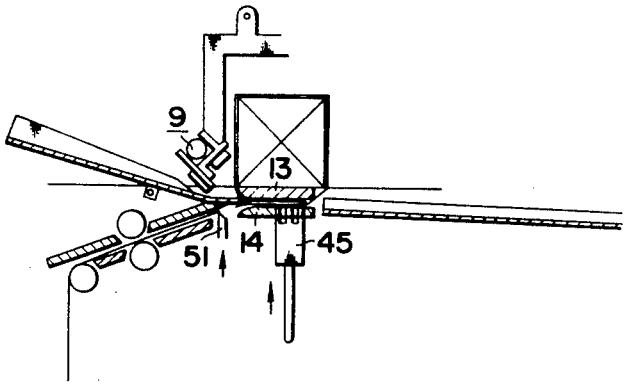

Next, the bundle metal pushup-binder 45 carrying one bundle metal 42 goes up together with the cutting edge 51. The tape 12 is thus cut off and at the same time the overlapped portion of the tape is bundled up with the metal 42, producing the bundled state as shown in FIG. 10. Then the upper guide plate or guide-bundle table 13 recedes in a direction perpendicular to the plane of the sheet of the drawings and the object is released free as it is tied up with the tape. Thus the tied object has only to be taken out of the device.

Figure 11:
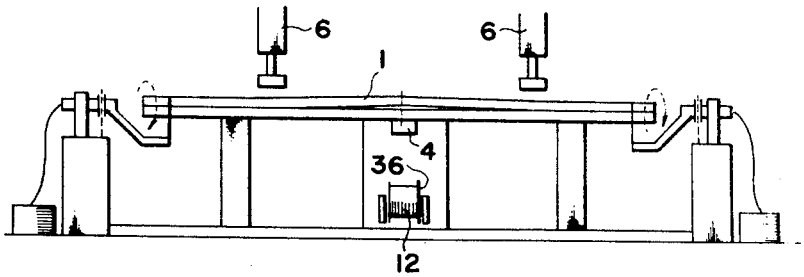
FIG. 11 is a diagram illustrating an application of the tying device according to the present invention to tie a long object to be tied at its middle portion.
Figure 12:
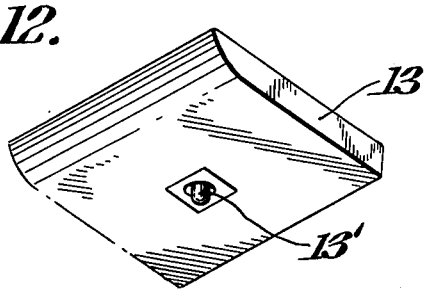
FIG. 12 is a partial view of the upper guide plate and its associated limit swtich.

FIG. 11 shows an application of the tying device according to the present invention to tie a long object to be tied at its middle portion, comparing with an application of a conventional tying machine to tie the same object 1 at its end portion. Such a conventional tying machine apparently cannot tie such a long object at its middle portion.

Such are the composition and function of the device according to the present invention. An object 1 to be tied is placed on the stand 2 with nothing above in normal direction to the tape feed slot 4 formed on the table 3. When the device is actuated, the arm holding the tape end comes up from below the table 3. With its tip folded substantially at right angles, the tape goes over the object and travels under the bottom of the object. Then the tape is bundled with a tape end bundle metal. Upon completion of this operation the arm is withdrawn again under the table 3. Thus even the mid-part of a long object can be easily and simply bundled with the tape. Since the table 3 is normally free with nothing projecting therefrom, the appearance of the device is simplified, enhancing the commercial value of the device.

What is claimed is:

1. A device for tying an object with tape comprising a stand for mounting an object to be tied, a slot in the stand for feeding tying tape, means for supplying tape to the slot, detector means disposed beyond the forward end of the slot for detecting the end of the tape, an arm pivotally mounted at one end thereof to the stand for movement within the slot, a grip mechanism at the other end of the arm constructed and arranged to grip the end of the tying tape when it is detected by the detector means, a pivotal connection in the arm between the ends thereof, means for moving the arm about its pivotal mounting and the pivotal connection to bring the end of the tape held by the grip mechanism over the object to be tied to the underside of the object and in overlapping relationship with a portion of the tape on the underside of the object, means for binding the overlapped portion of the tying tape, and means for cutting the tape adjacent the upstream end of the binding.

2. A device for tying an object with tape as in claim 1 wherein the detector and the grip mechanism are spaced apart from each other.

3. A device for tying an object with tape as in claim 1 wherein the arm includes first and second arm elements, and the means for moving the arm includes a fluid drive cylinder for each arm element.

4. A device for tying an object with tape as in claim 3 wherein the grip mechanism is disposed at the forward end of the second arm element and includes a transverse groove perpendicularly intersecting the direction of the tape feed slot, a raised wall portion adjacent the forward side of the transverse groove, and a lever for pressing a portion of the tying tape into the transverse groove and against the raised wall portion whereby the end of the tying tape includes an upwardly extending portion.

* * * * *